US012723321B2

(12) United States Patent
Furusawa

(10) Patent No.: US 12,723,321 B2
(45) Date of Patent: Sep. 1, 2026

(54) JET STREAM TYPE PLATING DEVICE

(71) Applicant: ASKA CORPORATION, Fukuoka (JP)

(72) Inventor: Takayuki Furusawa, Fukuoka (JP)

(73) Assignee: ASKA CORPORATION, Fukuoka (JP)

( * ) Notice: Subject to any disclaimer, the term of this patent is extended or adjusted under 35 U.S.C. 154(b) by 528 days.

(21) Appl. No.: 18/356,367

(22) Filed: Jul. 21, 2023

(65) Prior Publication Data

US 2025/0027225 A1 Jan. 23, 2025

(51) Int. Cl.

| | |
|---|---|
| ***C25D 17/00*** | (2006.01) |
| ***C25D 5/08*** | (2006.01) |
| ***C25D 7/12*** | (2006.01) |

(52) U.S. Cl.

CPC ..... *C25D 17/001* (2013.01); *C25D 5/08* (2013.01); *C25D 7/123* (2013.01)

(58) Field of Classification Search

None

See application file for complete search history.

(56) References Cited

U.S. PATENT DOCUMENTS

| | | | | |
|---|---|---|---|---|
| 4,304,641 | A * | 12/1981 | Grandia | C25D 5/08 204/229.8 |
| 6,030,512 | A | 2/2000 | Ihara et al. | |
| 2006/0081478 | A1 | 4/2006 | Sahoda et al. | |
| 2006/0113185 | A1 | 6/2006 | Kuriyama et al. | |
| 2016/0068988 | A1 * | 3/2016 | Uzoh | C25D 5/08 204/222 |

FOREIGN PATENT DOCUMENTS

| | | | |
|---|---|---|---|
| JP | S60-110471 | U | 7/1985 |
| JP | S62-037390 | A | 2/1987 |
| JP | H10-275811 | A | 10/1998 |
| JP | H11-246999 | A | 9/1999 |
| JP | 2000-195823 | A | 7/2000 |
| JP | 2005-097732 | A | 4/2005 |
| JP | 2006-117966 | A | 5/2006 |

OTHER PUBLICATIONS

Office Action for the Japanese Patent Application No. 2022-008953, issued on Feb. 14, 2023, original and machine English translation, 7 pages.

* cited by examiner

*Primary Examiner* — Louis J Rufo

(74) *Attorney, Agent, or Firm* — LUCAS & MERCANTI, LLP

(57) ABSTRACT

Provided is a nozzle structure in a jet plating tank through which the nozzle structure can be installed in the reduced space with simple composition, the plating liquid can be almost uniformly jetted on the semiconductor wafer surface and decentralization and homogenization of the plating liquid in the plating tank can be conducted, thereby thickness growth can be promoted. In the nozzle structure, a plurality of jet paths in an opening portion of the nozzle for jetting the liquid formed plating are and decentralization and homogenization of the plating liquid in the plating tank are conducted by the plating liquid jetted from a terminal end opening portion of each jet path.

4 Claims, 9 Drawing Sheets

JET STREAM TYPE PLATING DEVICE

BACKGROUND OF THE INVENTION

1. Field of the Invention

The present invention relates to a nozzle structure in a jet plating tank through which a plating time of metal plating, for example, copper plating formed on a semiconductor wafer surface can be shortened and film thickness of the plating film can be homogenized.

2. Description of Related Art

Conventionally, in order to increase conductivity, on a mounting surface (on which semiconductor chip is mounted and wiring is formed) of the semiconductor wafer, it is used an electroplating apparatus to form a plating film composed of metallic film, for example, copper film on a semiconductor wafer surface on a mounting surface of the semiconductor wafer.

This type of electroplating apparatus is basically composed from a plating tank to store predetermined amount of plating liquid including metallic ion, an anode portion connected to a metallic plate immersed in the plating liquid and energizing thereof and a cathode portion connected to the semiconductor wafer immersed in the plating liquid and energizing thereof.

Thereby, by applying positive and negative voltage, anode reaction (oxidation reaction) gives rise to the metallic plate in the plating tank and cathode reaction (reduction reaction) gives rise to the semiconductor wafer, respectively. Accordingly, the metallic plate is ionized and metallic ion is eluted in the plating liquid and ionized metal is precipitated on a mounting surface of the semiconductor wafer, as a result, the plating film is formed.

As such kind of electroplating apparatus, it is proposed various jet plating apparatuses each of which comprises a jet plating tank composed to actively eject the plating liquid in the tank toward the semiconductor wafer, a circulation pipe in which a start end portion is communicated and connected to the jet plating tank and a terminal end portion is confronted to the plating tank and a pump intervened in halfway of the circulation pipe (for example, see Patent Literature 1: unexamined patent application number 2005-97732 and Patent Literature 2: unexamined patent application number 2006-117966).

Further, this jet plating apparatus comprises an ejection nozzle of the plating liquid arranged at the terminal end of the circulation pipe. In the ejection nozzle, a plurality of openings to eject new plating liquid toward the semiconductor wafer and flow of the stored plating liquid is controlled so that the plating liquid is uniformly collided to the semiconductor wafer.

Thereby, precipitation of the plating film of the semiconductor wafer can be facilitated by the anode reaction and the cathode reaction with less power consumption and plating time can be shortened. Further, in-plane uniformity of the plating film thickness can be improved.

SUMMARY OF THE INVENTION

1. Problems to be Solved by Invention

However, according to the above conventional jet plating tanks, in any jet plating tank, there are problems that nozzle structure becomes complicated and disadvantageous in terms of cost, entire device becomes larger, thus extra installation space becomes necessary.

That is, as the ejection nozzle in Patent Literature 1, it is used an annular nozzle in which a plurality of openings are formed in torus at regular intervals. To arrange this nozzle in the plating tank, the plating tank should be formed with the width corresponding to the nozzle ring width, thus entire device grows in size. Further, nozzles should be composed to be arranged so that each ejection opening becomes adjustable toward the wafer. Therefore, there are problems that large installation space is necessary and flow control becomes complicated.

Further, the ejection nozzle shown in Patent Literature 2 is composed from a linear nozzle in which a single elongated opening is formed on a tubular one side surface or a plurality of openings are formed at regular intervals and this linear nozzle is composed so as to be able to move parallel against the semiconductor wafer in the plating tank, thereby fluid flow can be adjusted. Therefore, similar to the above, there is a problem that the device will grow in size corresponding to that the movement device is attached.

Especially, in any nozzle, due to that the plurality of openings or the elongated opening should be provided, it will occur influence of pressure drop occurring between opening portion of base end side of the nozzle positioning near the pipe and opening portion of terminal end side of the nozzle positioning far from the pipe, corresponding to distance based on the terminal end of the circulation pipe. Therefore, there is a problem that it will occur a difference in ejection amount of the plating liquid.

That is, flow pressure of the plating liquid in a nozzle base end portion at the nearby position of the circulation pipe becomes stable since the nozzle base end portion positions near the circulation pipe and ejection amount of the plating liquid from the base end side opening portion of the nozzle becomes a constant amount. On the other hand, flow pressure of the plating liquid at the terminal end portion of the nozzle existing in far position from the circulation pipe decreases since the plating liquid is ejected from openings existing therebetween. Therefore, the ejection flow amount of the plating liquid from the terminal end side opening portion decreases than the ejection flow amount from the base end side opening.

That is, it concludes that flow amount difference of the plating liquid occurs according to distance from the circulation pipe of each opening. Thus, drift occurs in the plating liquid stored in the plating tank and there will occur difference in flow amount of the plating liquid per unit time, as a result, there is a fear that unevenness in the film thickness formed on the semiconductor wafer surface occurs.

In order to dissolve the flow amount difference of the plating liquid from each opening, although it is proposed that aperture diameter or nozzle inner diameter is enlarged or shrunk corresponding to distance from the circulation pipe. However, the device should be designed taking feed pressure feed by the pump in halfway of the circulation pipe into consideration, as a result, structure thereof is complicated in vain.

On the contrary, in a case that it is adopted a general bent nozzle in which a single opening is formed, drift occurs within the nozzle and there is a fear that ejected jet flow becomes uneven. In FIGS. 9(*a*) and 9(*b*), it will be shown conventional jet nozzle 100 of bending type and schematical velocity distribution. Here, in light and shade shown in FIG. 9(*a*), an area dark in color shows an area where flow velocity is fast and an area pale in color shows an area where flow velocity is slow, as the velocity distribution of the plating liquid.

Generally, in single channel system, meandering passing through a bend 101 becomes low pressure area in the meandering inner side, thus flow velocity becomes faster and becomes high pressure area in the meandering outer side, thus flow velocity becomes slower. Therefore, in a case that the meandering reaches downstream side than the bend, it occurs influence of difference in flow velocity of the inner and outer sides of the meandering, thus the flow velocity distribution becomes uneven.

As a result, drift having difference in flow velocity up and down is ejected as it is from the terminal end opening 102 of the nozzle 100 and turbulence and the like occur within nozzle liquid stored. Thereby, the plating liquid cannot be uniformly collided to a surface W1 of the semiconductor wafer W, thus unevenness occurs in thickness of the plating film.

The present invention has accomplished considering the above circumstances and has a purpose to provide a nozzle structure of a jet plating tank through which the plating liquid is approximately uniformly jetted onto the surface of the semiconductor wafer opposing to the nozzle in spite of simple structure, and decentralization and homogenization of the plating liquid in the plating tank are conducted, thereby thickness glow can be prompted. Further, according to the present invention, the nozzle structure can be installed with low cost and space-saving. Furthermore, according to the present invention, the plating film can be formed on the semiconductor wafer in a short time while retaining in-plane uniformity.

2. Means to Solve Problems

In order to solve the above problems, the nozzle structure in jet plating tank of a plating apparatus according to the present invention, in which (1) a semiconductor wafer is arranged near one side wall of the jet plating tank and a nozzle for jetting plating liquid is arranged so as to oppose the semiconductor wafer, plating is conducted on a semiconductor wafer surface, wherein plurality of jet paths in an opening portion of the nozzle for jetting the plating are liquid formed and decentralization and homogenization of the plating liquid in the plating tank is conducted by the plating liquid jetted from a terminal end opening portion of each jet path.

Further, the nozzle structure in jet plating tank according to the present invention has characteristic at points of (2)~(4) hereinbelow.

(2) the plurality of jet paths formed in the opening portion of the jet nozzle for jetting the plating liquid are formed by a plurality of partition walls formed in the opening portion of the nozzle, (3) the plurality of jet paths formed in the opening portion of the jet nozzle for jetting the plating liquid are formed by a perforated plate arranged in the opening portion of the nozzle, and (4) the jet plating tank has a donut-like plate arranged between the semiconductor wafer arranged in the one side wall and the nozzle for jetting plating liquid, wherein the donut-like plate has a circular ring opening in a center thereof and a wall surface thereof opposes to the semiconductor wafer while forming a regular interval therebetween, and wherein a center of the ring opening concentrically positions with a center of the nozzle opening portion of the jet nozzle of the plating liquid and a center of semiconductor wafer.

3. Effects of Invention

According to one aspect of the present invention, a semiconductor wafer is arranged near one side wall of the jet plating tank and a nozzle for jetting plating liquid is arranged so as to oppose the semiconductor wafer, plating is conducted on a semiconductor wafer surface, wherein a plurality of jet paths in an opening portion of the nozzle for jetting the plating liquid and decentralization and homogenization of the plating liquid in the plating tank is conducted by the plating liquid jetted from a terminal end opening portion of each jet path. Thereby, the plating liquid flowing out from upstream to downstream through single path can be diverged by the plurality jet paths formed in the opening portion of the nozzle and split ejection of the plating liquid can be done. Therefore, flow velocity of the plating liquid ejected from each jet path can be rectified to a constant velocity, thus flow of the plating liquid in the plating tank can be in order to a predetermined direction and occurrence of drift can be suppressed.

That is, the plating liquid can be jetted respectively with substantial equal velocity from the terminal end opening of each jet path. Further, contact flow amount of the plating liquid per unit time to the semiconductor wafer surface opposing to the nozzle can be increased, thus thickness growth can be promoted. Further, the plating liquid can be uniformly jetted toward the semiconductor wafer surface as possible, thus the plating film having in-plane uniformity can be formed in a short time.

Especially, in a case that the jet nozzle is bent, when the plating liquid flowing out from the base end side in the nozzle opening portion is bent at the bent portion, velocity difference occurring between meandering outer side and meandering inner side in meandering can be dissolved, thus rectifying action to approximately homogenize the flow velocity can occur.

That is, based on that the plurality of jet paths are formed in the terminal end opening portion, it can be suppressed drift occurrence through which flow velocity distribution becomes uneven and the plating liquid can be rectified so that the plating liquid is jetted with a predetermined flow velocity from substantial entire area of the opening surface of the opening portion in the jet nozzle of the plating liquid.

Thereby, jet flow of the plating liquid jetting with a predetermined flow velocity can be produced while coinciding flow direction of the plating liquid in the plating tank with opposing direction perpendicular to the plane direction of the semiconductor wafer surface.

Jet colliding with the surface of the flow semiconductor wafer radially disperses as a center of colliding portion and is changed to wall flow flowing so as to trace the wafer surface. As a result, the plating liquid can be evenly contacted with entire wafer surface and it can be formed the plating film without uneven spots while facilitating thickness growth.

Further, according to another aspect of the present invention, the plurality of jet paths formed in the opening portion of the jet nozzle for jetting the plating liquid are formed by a plurality of partition walls formed in the opening portion of the nozzle. The plating liquid can be diverted in each jet path, thereby the plating liquid can be substantially uniformly and radially spread from the opening portion of the jet nozzle of the plating liquid, thus the plating liquid can be sent to the semiconductor wafer.

That is, the velocity difference occurring in bent flow of the plating liquid due to influence of low-pressure area of the inner side and high-pressure area of the outer side in the bent portion of the nozzle can be dissolved by each of jet paths in which up and down distance therebetween is narrowed, thus rectifying action by which flow velocity is approximately homogenized can be further improved.

Further, according to further another aspect of the present invention, the plurality of jet paths formed in the opening portion of the jet nozzle for jetting the plating liquid are formed by a perforated plate arranged in the opening portion of the nozzle. In spite that the structure is further simplified, similar to the above, that is, the velocity difference occurring in bent flow of the plating liquid due to influence low-pressure area of the inner side and high-pressure area of the outer side in the bent portion of the nozzle can be dissolved, thus rectifying action by which flow velocity is approximately homogenized can be further improved.

Further, according to further another aspect of the present invention, the jet plating tank has a donut-like plate arranged between the semiconductor wafer arranged in the one side wall and the nozzle for jetting plating liquid, wherein the donut-like plate has a circular ring opening in a center thereof and a wall surface thereof opposes to the semiconductor wafer while forming a regular interval therebetween, and wherein a center of the ring opening concentrically positions with a center of the nozzle opening portion of the jet nozzle of the plating liquid and a center of semiconductor wafer. Thereby, the wall flow of the plating liquid going to the outer side from the center of the semiconductor wafer flows with a predetermined distance, thus it can be suppressed that the wall flow becomes turbulence due to that the wall flow is attenuated in the outer side. Thus, the plating liquid evenly contacts with entire area of the semiconductor wafer surface, therefore formation of the plating film without uneven spots can be promoted.

DETAILED DESCRIPTION

Figure 1:
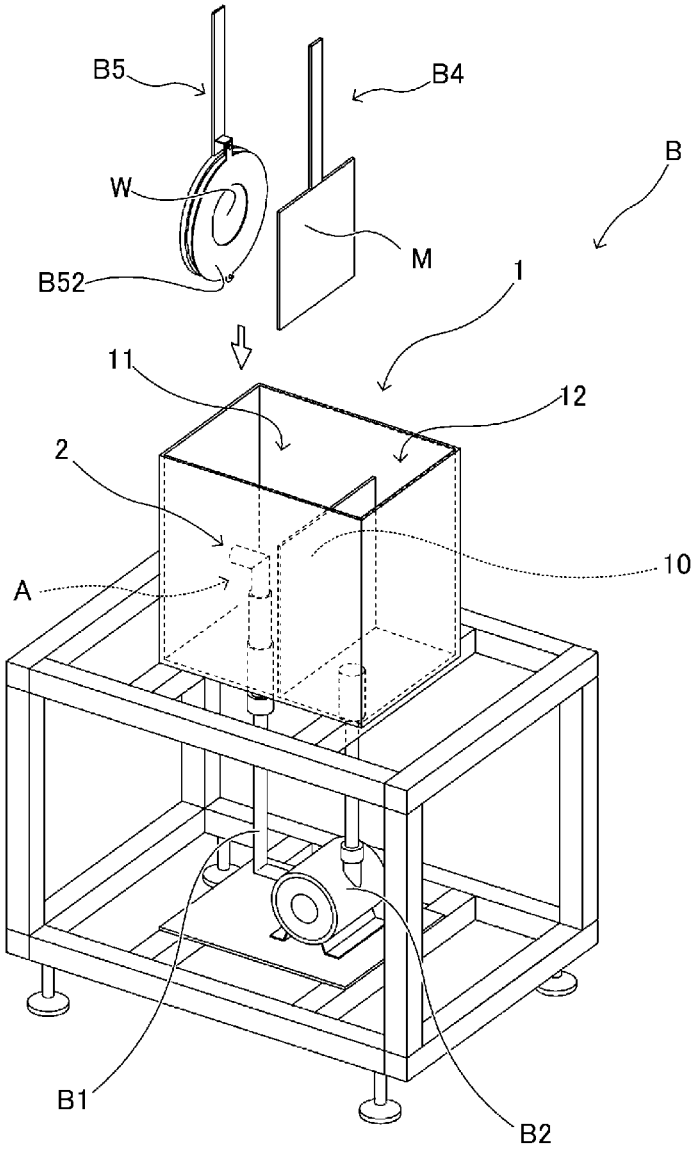
FIG. 1 is a whole perspective view of the jet plating apparatus having the nozzle structure according to the present invention.

The gist of the present invention lies in providing a nozzle structure of jet plating tank in which a semiconductor wafer is arranged near one side wall of the jet plating tank and a nozzle for jetting plating liquid is arranged so as to oppose the semiconductor wafer, plating is conducted on a semiconductor wafer surface, wherein a plurality of jet paths in an opening portion of the nozzle for jetting the plating liquid and decentralization and homogenization of the plating liquid in the plating tank is conducted by the plating liquid jetted from a terminal end opening portion of each jet path.

Further, it is characterized in that the plurality of jet paths formed in the opening portion of the jet nozzle for jetting the plating liquid are formed by a plurality of partition walls formed in the opening portion of the nozzle.

Further, it is characterized in that the plurality of jet paths formed in the opening portion of the jet nozzle for jetting the plating liquid are formed by a perforated plate arranged in the opening portion of the nozzle.

Further, the jet plating tank has a donut-like plate arranged between the semiconductor wafer arranged in the one side wall and the nozzle for jetting plating liquid, wherein the donut-like plate has a circular ring opening in a center thereof and a wall surface thereof opposes to the semiconductor wafer while forming a regular interval therebetween, and wherein a center of the ring opening concentrically positions with a center of the nozzle opening portion of the jet nozzle of the plating liquid and a center of semiconductor wafer.

Recently, in the semiconductor wafer, in order to improve conductivity and reduce power consumption by lowering resistance, in addition to the mounting surface, plating is also conducted on the back side thereof. In particular, copper plating favorable to cost and conductivity becomes mainstream.

The semiconductor wafer on both sides of which copper plating is conducted is utilized for electronic terminals such as smart phone and laptop personal computer and power consumption of a battery built therein is reduced as possible while reducing electrical resistance and making conductivity good.

The film thickness of this plating film is requested to make thicker (for example, more than 3 μm) than the film thickness of the plating film (for example, 1~3 μm) formed by a general plating method such as sputtering method or vapor deposition method.

In other words, the sputtering method or the vapor deposition method is not suitable to form the thick plating film and it is usual to use the electroplating method, that is, the electroplating apparatus. Among them, the jet plating apparatus is effective at the point that the plating film can be formed in energy saving and in a short time without increasing metallic ion concentration in the plating liquid.

That is, according to the nozzle structure in jet plating tank of the present invention, in spite of simple composition, contact opportunity of the metallic ion in the plating liquid to the surface of the semiconductor wafer can be drastically increased, thus the thick plating film can be formed on the wafer surface in a short time without uneven spots. According to the nozzle structure of the present invention, the existing jet plating apparatus can be changed to the highspeed electroplating apparatus by retrofitting to the existing jet plating apparatus. Therefore, the present invention can be said an epochal invention.

First Embodiment

Figure 2:
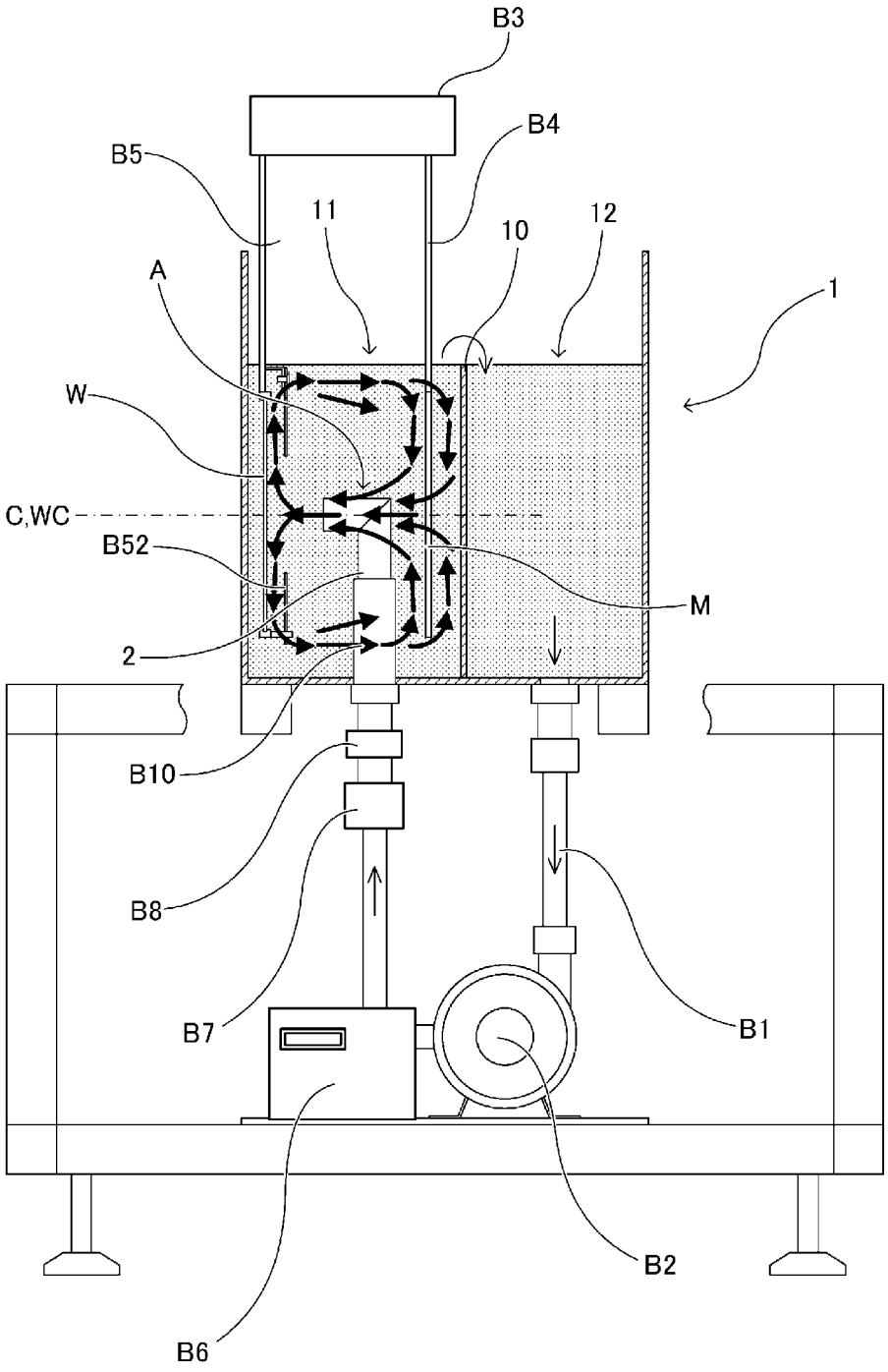
FIG. 2 is a schematical side view of the jet plating apparatus having the nozzle structure according to the present invention.
Figure 3:
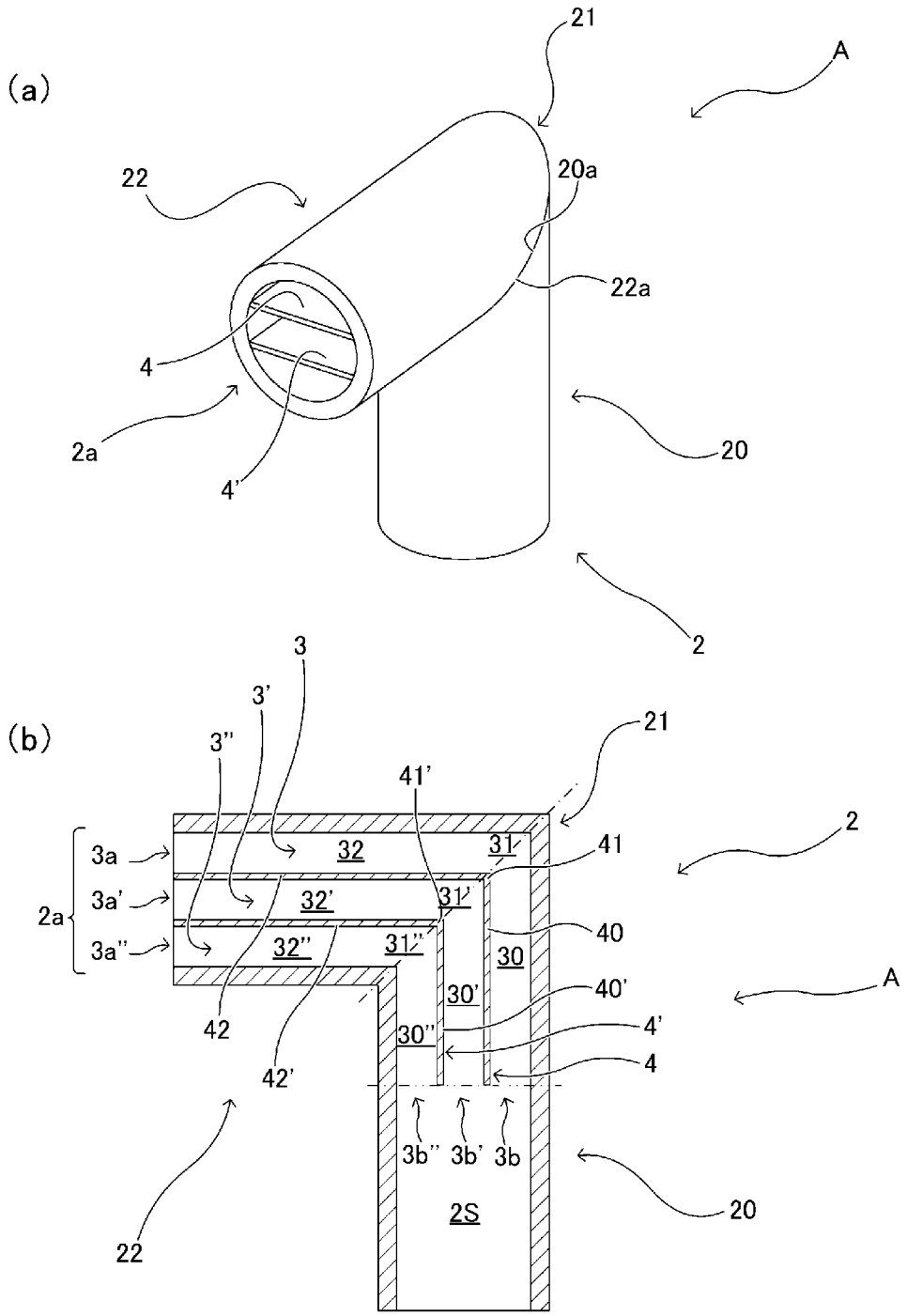
FIG. 3 shows a perspective view and a sectional view showing the nozzle structure according to the first embodiment.
Figure 4:
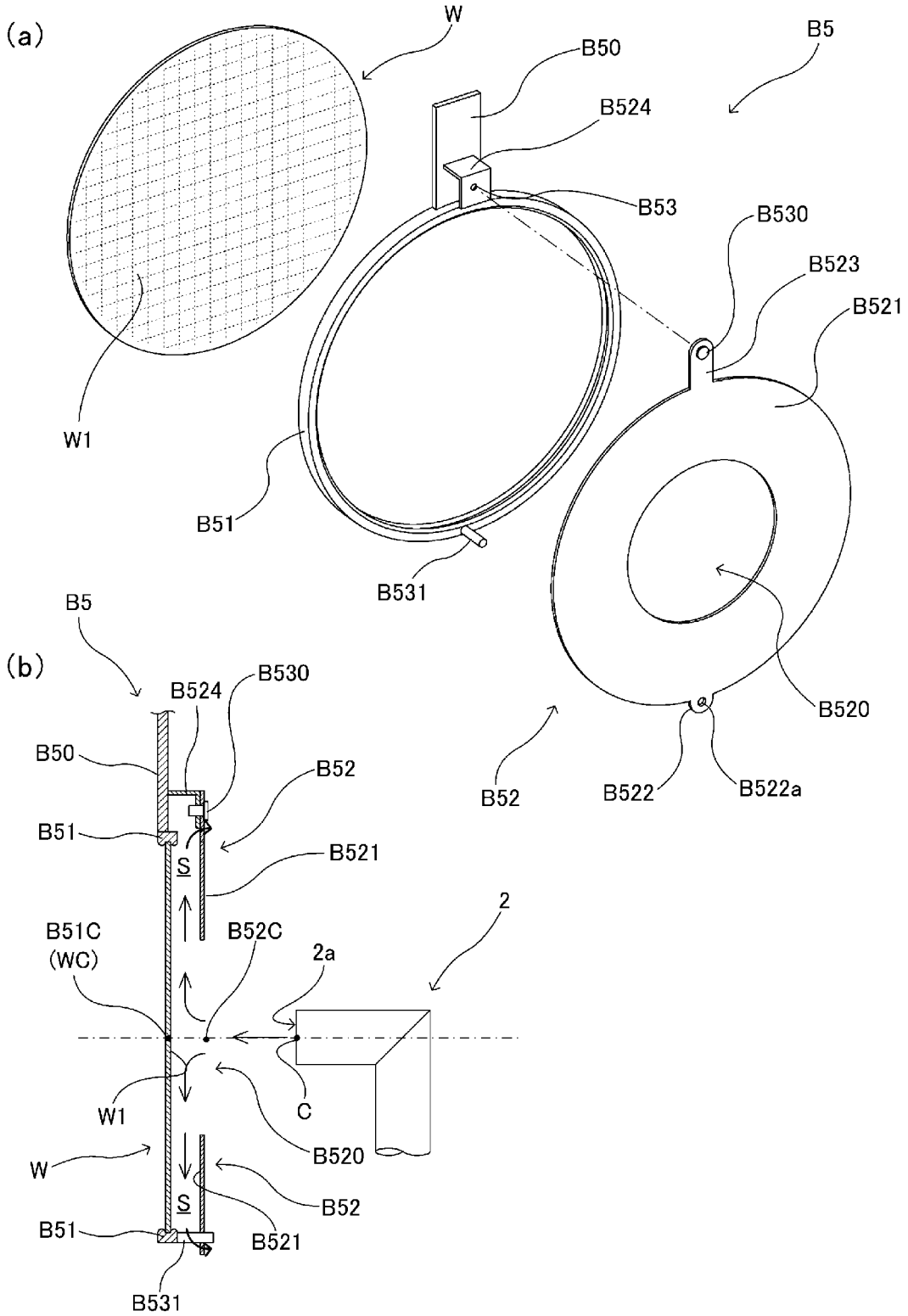
FIG. 4 shows a disassembled perspective view and schematical side view indicating the composition of a wafer holder according to the first embodiment.
Figure 5:
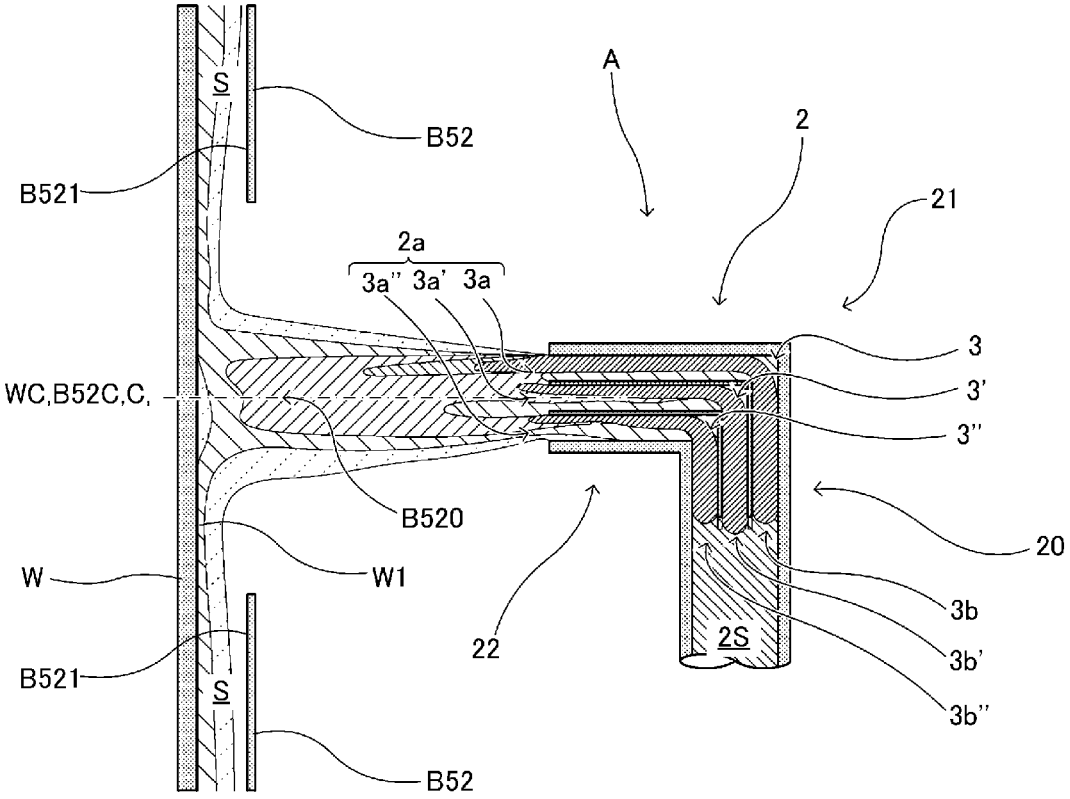
FIG. 5 is a schematical velocity distribution map of jet flow by the nozzle structure according to the first embodiment.

The first embodiment of nozzle structure in jet plating apparatus according to the present invention will be described. FIGS. 1 and 2 are an entire perspective view and a schematical side view of the jet plating apparatus having the nozzle structure. FIG. 3 is a perspective view and a sectional view indicating composition of the nozzle structure according to the embodiment 1. FIG. 4 are a disassembled perspective view and a schematical side view indicating a wafer holder of the embodiment 1. FIG. 5 is a schematical velocity distribution map of jet flow when using the nozzle structure of the embodiment 1.

As shown in FIGS. 1 and 2, the jet plating apparatus B is roughly composed from a jet plating tank 1 having a plating liquid ejection nozzle 2 with a nozzle structure A, a circulation pipe B1 communicated and connected to a bottom of the plating tank 1 at both end portions, a supply pump B2 arranged halfway of circulation pipe B1, a metallic plate M and the semiconductor wafer W mutually opposed face to face in the plating tank 1 and suspended and supported at a distance and a power supply part B3 respectively adding positive and negative voltage to the metallic plate M and semiconductor wafer W.

In the circulation pipe B1, as shown in FIG. 2, sign B6 is a flowmeter intervened downstream side than the supply pump B2, to measure flow amount of the plating liquid, sign B7 is a heater arranged downstream side than the flowmeter B6, to keep warm the plating liquid at 40~50° C. and promote anode • cathode reaction, sign B8 is a filter arranged downstream side than the heater B7, to trap and filter particles such as dust and the like carelessly adhering to the semiconductor wafer W and liberating in the plating liquid.

That is, the flowmeter B6, the heater B7, the filter B8 are respectively and sequentially arranged from upstream side to downstream side between the supply pump B2 and the nozzle 2 in the circulation pipe B1. Here, the filter B8 is composed from a detachable joint with filter or a piping.

As shown in FIGS. 1 and 2, the jet plating tank 1 is a rectangular box-type container with an upper opening capable to store the plating liquid with a certain amount and inner space thereof is partitioned through an overflow wall 10 set up at approximately center portion of a bottom side wall in a longitudinal direction. Thereby, it is formed a plating tank part 11 to conduct plating on the semiconductor wafer surface and a reserve tank part 12 to temporarily store the plating liquid overflowed the overflow wall 10 from the plating tank part 11.

In the jet plating tank 1, the plating tank part 11 and the reserve tank part 12 are installed through the overflow wall 10 arranged therebetween, thus the jet plating tank 11 is partitioned in the first half part and the second half part.

In the plating tank 11, the semiconductor wafer W and the metallic plate M are installed in a suspended state and in an opposing state in the plating liquid stored in the plating tank part 11 through the wafer holder B5 and a metallic plate holder B4. The maximum storage amount of the plating liquid in the plating tank part 11 is the minimum amount (at least, amount capable of immersing whole semiconductor wafer W) for plating, therefore volume reduction can be attempted and the plating tank part 11 can be compacted as possible.

Here, the wafer holder B5 and the metallic plate holder B4 are respectively composed of conductive material and both are connected to the power supply part B3. To lower ends of the wafer holder B5 and the metallic plate holder B4, the semiconductor c W and the metallic plate M are respectively suspended. When energizing the semiconductor wafer W and the metallic plate M, the metallic plate M becomes anode part and the semiconductor wafer becomes cathode part.

Concretely, the semiconductor wafer W is suspended by the wafer holder B5 and arranged so as to be opposed to vicinity of the one side wall of the plating tank part 11 with a relation of face to face. Further, the metallic plate M is suspended by the metallic plate holder B4 and is arranged so as to be opposed to vicinity of the overflow wall 10 with a relation of face to face.

The wafer holder B5 is, as shown in FIG. 4, composed from a suspending part B50 of a rectangular metallic plate connected to the power supply part B3, a holder body B51 with a short cylinder ring shape connected to the lower end of the suspending part B50 and a donut-like plate B52 connected to the suspending part B50 retaining a predetermined distance between the front face of the holder body B51.

That is, the jet plating tank 1 is composed from the semiconductor wafer W installed in the plating tank part 11, the donut-like plate B52 arranged so as to oppose thereto and the plating liquid jetting nozzle 2 with a substantially L-shape arranged behind the donut-like plate B52.

On an inner surface of the holder body B51 in the wafer holder B5, it is formed a recess to engage an outer edge of the wafer and the wafer is fixed inside the recess.

The donut-like plate B52 has a ring shape in which an opening B520 is formed in the center thereof so as to be a donut shape and a predetermined distance S is formed to jet the plating liquid between a ring surface B521 and the wafer surface W1. Here, a positional relation among the plating liquid jet nozzle 2, the donut-like plate B52 and semiconductor wafer W is realized so that an opening center C of the opening portion 2*a* in the plating liquid jetting nozzle 2, an opening center B51C of the donut-like plate B52 and a wafer center WC of the semiconductor wafer W are coaxially positioned.

Further, as a predetermined face-to-face distance of the semiconductor wafer W and the donut-like plate B52, a constant distance S is formed therebetween. In order to form the constant distance S, a pin B530 set up from a flange B523 protruded at an upper end of a circular plate of the donut-like plate B52 and a perforation B53 formed on a support part B524 of the donut-like plate with a reverse-L shape, the flange B523 being protruded on the suspending part B50, are integrally mated, thereby the semiconductor wafer W and the donut-like plate B52 are arranged face-to-face in a state that the constant distance S is retained therebetween. Here, the constant distance is set to a distance of approximate 1.0 mm~10 mm so that the wall flow of the plating liquid flowing along the semiconductor wafer surface W1 can pass.

Further, a circular width d of the donut-like plate B52 is formed to a length of approximate ½~⅕ against a radius r of the semi¥conductor wafer W Sign B531 in FIG. 4(*a*) is a pin protruded from a circular ring lower end in the holder body B51 of the semiconductor wafer W and when the donut-like plate B52 is opposed to the semiconductor wafer W of the holder body 51 through the constant distance S the pin B531 is inserted in an insertion hole B522*a* of the lower end flange B522 protruded on the donut-like plate B52, thereby a position of the donut-like plate B52 can be fixed.

As mentioned in the above, since the ring opening B520 is formed in the center thereof as a donut opening, jet flow of the plating liquid jetted from a nozzle opening portion 2*a* is jetted in the ring opening B520 and flows in the constant distance S between the semiconductor wafer W, the distance S being formed behind the ring opening B520. At this point, the donut-like plate B52 forms a flow path.

By the donut-like plate B52, jet flow of the plating liquid is dispersed in a space between the donut-like plate B52 perpended along the semiconductor wafer surface W1, that is, the jet flow is dispersed in the constant gap S with a donut shape formed between the ring surface with a donut shape of the semiconductor wafer W and the ring surface B521 of the donut-like plate B52.

Thereby, it can be prevented that flow velocity is attenuated according that wall flow described hereinafter goes to outer side from the center of the semiconductor wafer W, as a result, the wall flow becomes turbulence. Thus, the plating liquid can be evenly contacted with entire surface of the semiconductor wafer W.

A size of plating tank part 11 against the semiconductor wafer W suspended and supported by the wafer holder B5 is set to a size that the semiconductor wafer w is perfectly immersed in the plating liquid.

That is, a size of the overflow wall 10 which determines the maximum storing amount of the plating liquid in the plating tank part 11 is designed corresponding to the diameter of the semiconductor wafer W immersed and supported in the plating liquid so that the plate surface faces along the horizontal direction. The height h and width d of the overflow wall 10 are set so as to be longer than the diameter ϕ of the semiconductor wafer W.

Concretely, a relation of the height (mm) and width (mm) of the overflow wall 10 and the diameter ϕ (mm) of the semiconductor wafer W is determined as h (mm)−ϕ (mm) =10~150 (mm) and d (mm)−ϕ (mm)=50~150 (mm).

The overflow wall 10 of the present embodiment is a partition plate with a square shape in front view As for the size thereof, for example, the height and the width are set almost same and the overflow wall can be corresponded to plating of the semiconductor wafer W less than ϕ 200 mm (8 inches).

In this plating tank part 11, the semiconductor wafer W and the metallic plate M are symmetrically arranged bordering on the center part of front rear length in side view, so that the semiconductor wafer W positions in the vicinity of the front side wall and the metallic plate M positions in the vicinity of the overflow wall 10. Separation distance between the semiconductor wafer W and the metallic plate M is, for example, 150~170 mm.

The reserve tank part 12 is the rectangular box-type container with an upper opening adjacent to the plating tank part 11 through the overflow wall 10 and temporarily stores the plating liquid overflowed from the plating tank part 11. The reserve tank part 12 of the present embodiment is composed so that, for example, the plating liquid of 7~9 L can be stored.

Here, the plating tank part 11 and the reserve tank part 12 may be composed so as to be respectively arranged up and down direction. In this case, the plating tank part 11 arranged at the upper position and the reserve tank part 12 arranged at the lower position may be arranged and communicated through an overflow pipe. Concretely, a start opening of the overflow pipe is made it come to one side upper portion of the plating tank part 11 and a terminal opening of the overflow pipe is made it come to one side of the reserve tank part 12.

In the jet plating tank 1 compacted according to the above, the plating tank part 11 and the reserve tank part 12 are composed so as to be connected and communicated through a circulation pipe B1 with an approximately U-shape which is respectively connected with bottom portions.

As shown in FIGS. 1 and 2, a start end portion of the circulation pipe B1 is connected and communicated to a bottom center portion of the reserve tank part 12 and a terminal end portion of the circulation pipe B1 is penetrated a bottom center portion of the plating tank part 11 and is protruded in an upper direction so that a terminal opening of the circulation pipe B1 is made it come to an upper side of the plating tank part 11. A supply pump B2 arranged in halfway of circulation pipe B1 sends the plating liquid of 8~15 L per one minute to the terminal opening.

To a terminal end portion B10 of the circulation pipe B1 protruded, the jetting nozzle 2 bent in approximately L-shape is worn so that the plating liquid is finally jetted in the jet plating tank 1 (plating tank part 11).

The jetting nozzle 2, as shown in FIG. 3(*a*), is a cylindrical pipe bent at right angles with a reverse L-shape in side view and is composed from a vertical part 20 at a base end side extended in a vertical direction and a horizontal part 22 of a top end side extended in a horizontal direction through a bent portion 21 at a top end of the vertical portion 20.

As shown in FIG. 2, a terminal opening portion of the horizontal part 22 is a nozzle opening portion 2*a*. Further, an opening center (axial center of horizontal part 22) of the nozzle opening portion 2*a* is coincided with a plane center WC of the semiconductor wafer surface W1 and an opening surface is faced to the surface of the semiconductor wafer W. The jetting nozzle 2 is connected and communicated with the terminal end portion B10 of the circulation pipe B1 through the vertical part 20.

Further, the jetting nozzle 2, as shown in FIGS. 3(*a*) and 3(*b*) has joint surfaces 20*a*, 22*a* cut and formed in the vertical part 20 and horizontal part 22 by 45° slope against the cylinder shaft and the bent portion 21 bent by 90° is formed by superimposing both joint surfaces 20*a*, 22*a*.

In other words, in the plating liquid jetting nozzle 2, an inner diameter of the bent portion 21 is made maximum and inner diameters of the vertical part 20 and the horizontal part 22 are made as same as the inner diameter of the bent portion 21, thereby the plating liquid jetting nozzle 2 forms single path continuing respective inner spaces. Therefore, occurrence of drift according to meandering of the plating liquid in the bent portion 21 can be suppressed as possible. Here, the inner diameter of the vertical part 20 and the horizontal part 22 is approximately set to 25~27 mm.

As shown in FIG. 2, the height of the vertical part 20 is set to a height capable of retaining a level so that a center axis of the horizontal part 22 positioned at the upper end of the vertical part 22, that is, an opening center C of the nozzle opening portion 2*a* in the jetting nozzle 2 coincides with the surface center WC of the semiconductor wafer surface W1 suspended within the jet plating tank 1 (plating tank part 11) on the same line.

In order to freely set the above contents, it can be composed that height position of the nozzle is made adjustable by sliding the vertical part 20 of the jetting nozzle 2 up and down against the terminal end portion 10 of the circulation pipe B1.

Further, horizontal protrusion length of the horizontal part 22 from the vertical part 20 is determined by a relative length between the nozzle opening portion 2*a* of the top and the semiconductor wafer W opposing thereto.

That is, it is favorable that a distance between the semiconductor wafer surface W1 opposing to the opening surface of the nozzle opening portion 2*a* is 3~50 mm on becoming that the jet flow of the plating liquid jetted from the nozzle opening portion 2*a* by 20~30 L per minute becomes the wall flow radially dispersing centered on the semiconductor wafer surface W1.

In the jet nozzle 2, as shown in FIGS. 3(*a*) and 3(*b*), it is constructed a nozzle structure A so that a plurality of jet flow paths 3 are formed in the opening portion 2*a* and decentralization and homogenization of the plating liquid in the plating tank 1 is conducted by plating liquid jetted from the terminal opening portion 3*a* of each jet flow path 3.

In the cylindrical jet nozzle 2 with a reverse L-shape, as shown in FIGS. 3(*a*) and 3(*b*), the plurality of partition walls 4, 4' with the same reverse-L shape as an outer shape of the jet nozzle 2 in the outer body are arranged while mutually retaining a predetermined distance therebetween.

Within the jet nozzle 2, jet paths formed in multiple layers are formed by the distance between the plurality of partition walls 4 and the distance between inner walls of the outer cylindrical body and the partition walls.

Therefore, end surfaces of the horizontal wall portion 42, 42' in the plurality of partition walls 4, 4' are emerged to the opening end surfaces of the jet nozzle 2 and the vertical wall portions 40, 40' are respectively formed to the rear end of each of horizontal wall portions 42, 42', thereby the jet flow paths with reverse-L shape formed in multiple layers are formed inside the jet nozzle 2 with reverse-L shape.

The partition wall 4, 4', as shown in FIG. 3(*b*), is respectively a bent plate with reverse-L shape which is similar shape of reverse-L shape of the jet nozzle 2 in side view and are composed from the inner partition plate 4' arranged in the bent inner side with reverse-L shape and the outer partition plate 4 arranged in the bent outer side with reverse-L shape.

The inner and outer partition plates 4, 4', as shown in FIG. 3(*b*), are respectively composed from vertical wall portions 40, 40' vertically arranged corresponding to the vertical part 20 within the jet nozzle 2, bent wall portions 41, 41' bent and arranged corresponding to the bent portion 21 and horizontal wall portions 42, 42' horizontally arranged corresponding to the horizontal part 22. In a nozzle opening inner part 2S, the horizontal wall portion 42, 42' are arranged up and down in the horizontal part 22 and the vertical wall portions 40, 40' are arranged parallel in forward and backward with a predetermined distance therebetween in the vertical part 20.

Concretely, in the nozzle opening inner part 2S, the inner and outer partition walls 4, 4' are arranged in the horizontal part 22 so that the horizontal wall portions 42, 42' are positioned parallel to the plane evenly spaced in the up and down direction, further, in the vertical part 20, the vertical wall portions 40, 40' are positioned parallel to the plane evenly spaced in the forward and backward direction. Further, along virtual diagonal (in FIG. 3(*b*), superimposed portion of mutual joint surfaces 20*a*, 22*a* of the vertical part 20 and the horizontal part 22 indicated by dashed line), the vertical wall portions 40, 40' are positioned so that corner portions 41, 41 thereof are put together. Thereby, the single path bent at a right angle in the nozzle opening inner part 2S of the jet nozzle 2 is divided and partitioned into a plurality of jet flow paths 3.

Each jet flow path 3, as shown in FIG. 3(*b*), is composed from up and down side jet flow paths 3, 3" formed in long dome shape formed at up and down portions of the nozzle opening inner part 2S in radial sectional view of the nozzle opening inner part 2S and a center side jet flow path 3' formed at center portion between the up and down side jet flow paths 3, 3', having round rectangle and both ends thereof being formed in arc.

Further, each of the jet flow paths 3~3" is formed through the inner and outer partition walls 4, 4' as a path of similar shape to reverse-L shape of the jet nozzle 2 in sectional view of the nozzle opening inner part 2S.

Concretely, the jet flow paths 3~3", as shown in FIG. 3(*b*), respectively have vertical flow paths 30~30" extended to vertical direction corresponding to the vertical part 20 in the nozzle opening inner part 2S, bent flow paths 31~31" bent at a right angle and extended to vertical direction corresponding to the bent part 21 and horizontal flow paths 32~32" extended in horizontal direction corresponding to the horizontal part 22.

The reverse-L shape partition walls 4, 4', as shown in FIG. 3(*b*), are flush with the opening end surface of the jet nozzle 2 and terminal end edges of the reverse-L shape partition walls 4, 4' reach halfway of the vertical part 20 of the jet nozzle 2.

Each of vertical widths of jet flow paths 3~3" is made approximate ⅓~¼ length of inner diameter of the vertical part 20 and the horizontal part 22. Here, number of jet flow paths 3~3", vertical width thereof, that is, number of partition wall 4, mutual distance thereof are not especially limited so long as drift of the plating liquid in the nozzle opening inner part 2S can be suppressed.

For example, in the jet nozzle 2, a plurality of jet flow paths can be formed so that vertical length gradually shrink from outside to inside of L shape through the plurality of partition walls 4, 4' and flow velocity of the maximum velocity area in the outermost circumference side of the bent flow in the bent part 21 can be attenuated.

Figure 9:
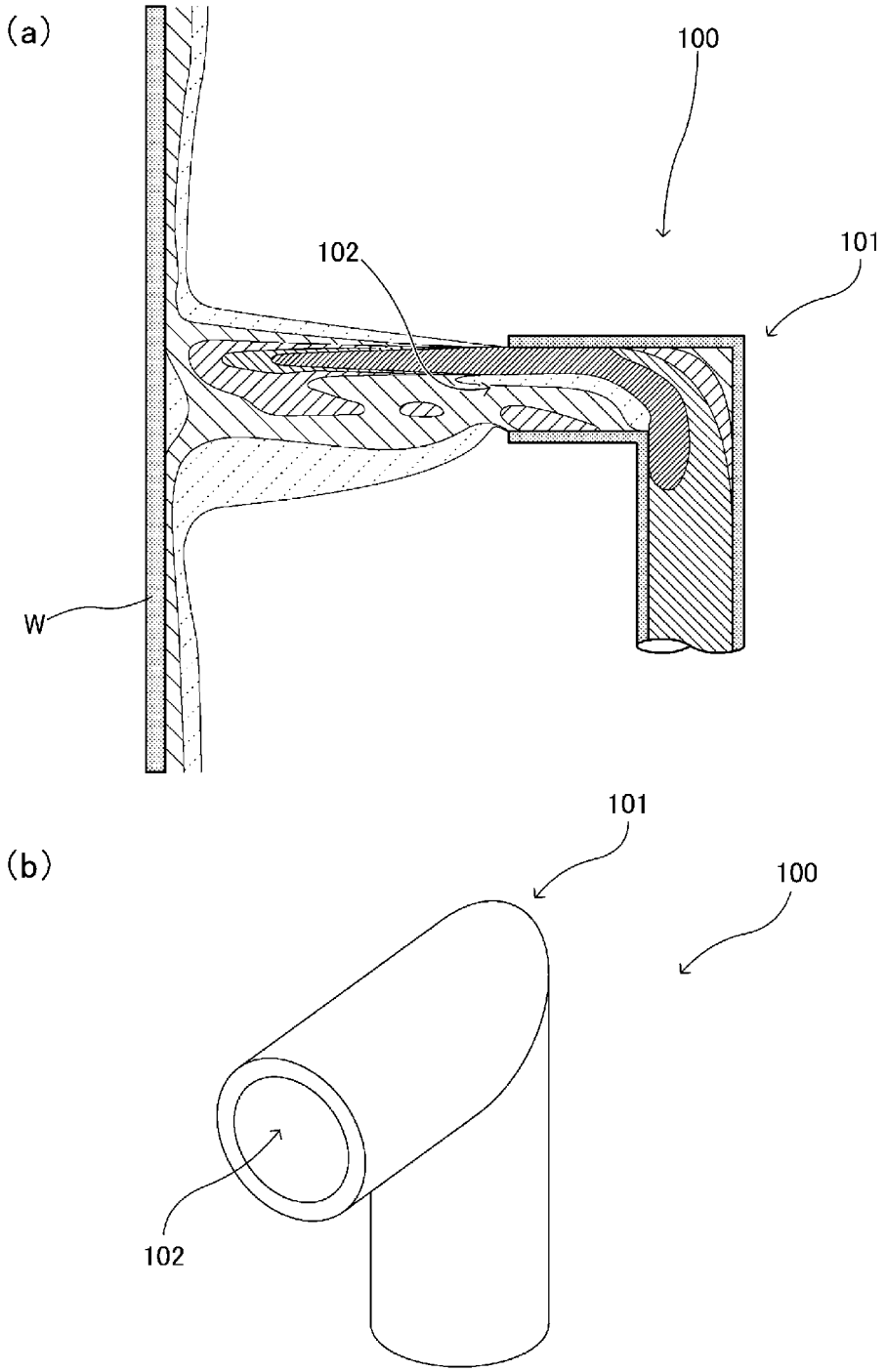
FIG. 9 shows a schematical velocity distribution map and an external view indicating the composition of the conventional jet nozzle.

According to the jet flow paths 3~3", as shown in FIG. 5, when the plating liquid flowing out from the vertical part 20 of the base end side in the nozzle opening inner part 2S of the jet nozzle 2 is bent at the bent part 21, velocity difference is eliminated between inner and outer circumference sides in the bent flow and flow velocity and flow amount are made constant in the horizontal part 22. Here, in light and shade in FIG. 5, deep color area indicates the area where flow velocity is fast and thin color area indicates the area where flow velocity is slow, as flow velocity distribution of the plating liquid similar to FIG. 9.

Concretely, as shown in FIG. 5, the plating liquid flowing out from the vertical part 20 of the base end side is diverted and entered in each of the jet flow paths 3~3" by dividing pressure feed from the pump equally before the plating liquid becomes bent flow at the bent part 21.

Although the plating liquid respectively diverted and fed in each of the jet flow paths 3~3" reaches the bent part 21 which becomes cause of drift, as shown in FIGS. 3(*b*) and 5, vertical width (distance between bent inner corner and bent outer corner) in the bent flow paths 31~31" of jet flow paths 3~3" is narrower than the vertical width of the bent portion in the single flow path, thereby flow velocity difference between the inner and outer circumference sides in the bent flow is eliminated, thus drift is unlikely to occur.

That is, pressure loss difference does not cause between the inner and outer circumference sides by each of the jet flow paths 3~3" and pressure is regulated, and pressure feed of the pump is diverted to each of the jet flow paths 3~3" while retaining pressure feed of the pump as possible, thereby the plating liquid is flown out to the horizontal flow path 32~32" in each of the flow paths.

As shown in FIGS. 3(*b*) and 5, the plating liquid flowing out through the horizontal flow paths 32~32" of the jet flow paths 3~3" finally becomes jet flow with constant flow velocity and constant flow amount from each of the terminal end opening portion 3*a*~3*a*" formed flush with the nozzle opening portion 2*a*, further the plating liquid is uniformly jetted. Here, in FIG. 2, thick arrow indicates flow of the plating liquid stored in the plating tank part 11.

The plating liquid jet flow emitted in the plating liquid stored in the plating tank part 11 from the nozzle opening portion 2*a* is, as shown in FIG. 2, produces constant distributed induced flow in the stored plating liquid.

That is, the nozzle liquid including in most metallic ion eluted from metallic plate M positioned at rear position of the nozzle is sent toward the semiconductor wafer surface W1 while getting involved in the plating liquid jet flow.

At that time, the plating liquid jet flow becoming mainstream of the plating liquid goes to the surface center WC of the semiconductor wafer surface W1 opposing to the nozzle opening portion 2*a*. When the plating liquid jet flow runs into the surface center WC of the semiconductor wafer surface W1, the plating liquid radially spreads from the portion run thereto and becomes the wall flow along the semiconductor wafer surface W1.

As shown in FIG. 2, the wall flow goes out from the center of the semiconductor wafer W1 to the outer edge so as to trace the entire area of the semiconductor wafer surface W1, collides with flooded surface, bottom side wall of the plating tank part 11 and the left and right side walls and turs back to the rear side. Thereby, the wall flow becomes returning wall flow along each surface and flows to rear position at which the metallic plate M positions.

In particular, in the present embodiment, as shown in FIG. 4(*b*), since the wafer holder B5 has the donut-like plate B52, although the wall flow on the semiconductor wafer surface W1 is gradually attenuated according that the wall flow goes to the peripheral edge from the center, the flow direction of the wall flow is guided from outer side through the donut-like plate B52, thus the wall flow can be rectified while suppressing that the wall flow attenuated in the peripheral edge is changed into the turbulence.

Therefore, it can be prevented that the turbulence carelessly occurs in the outer side of the semiconductor wafer surface W1, the plating liquid stagnates, thereby thickness of the plating film becomes uneven.

As mentioned, as shown in FIG. 2, in the plating liquid stored in the plating tank part 11, it orderly occurs circuit path having center flow sending area in which the plating liquid flows forward in the center portion in front view from each of the jet flow path 3~3" by setting the nozzle position as the center, wall flow area in which the wall flow is radially spread in up and down and left and right directions along the semiconductor wafer surface W1 to the front side and return wall flow area in which the wall flow flows along the flooded surface and the bottom side wall of the plating tank part 11 and left and right side walls to the rear side.

Thereby, while attempting homogenization of metallic ion concentration in the plating liquid, the plating liquid can be preferentially and inductively sent to the semiconductor wafer W by the plating liquid jet flow according to which the plating liquid including a plenty of metallic ions eluted from the metallic plate M is orderly jetted from the nozzle opening portion 2*a*.

Second Embodiment

Figure 6:
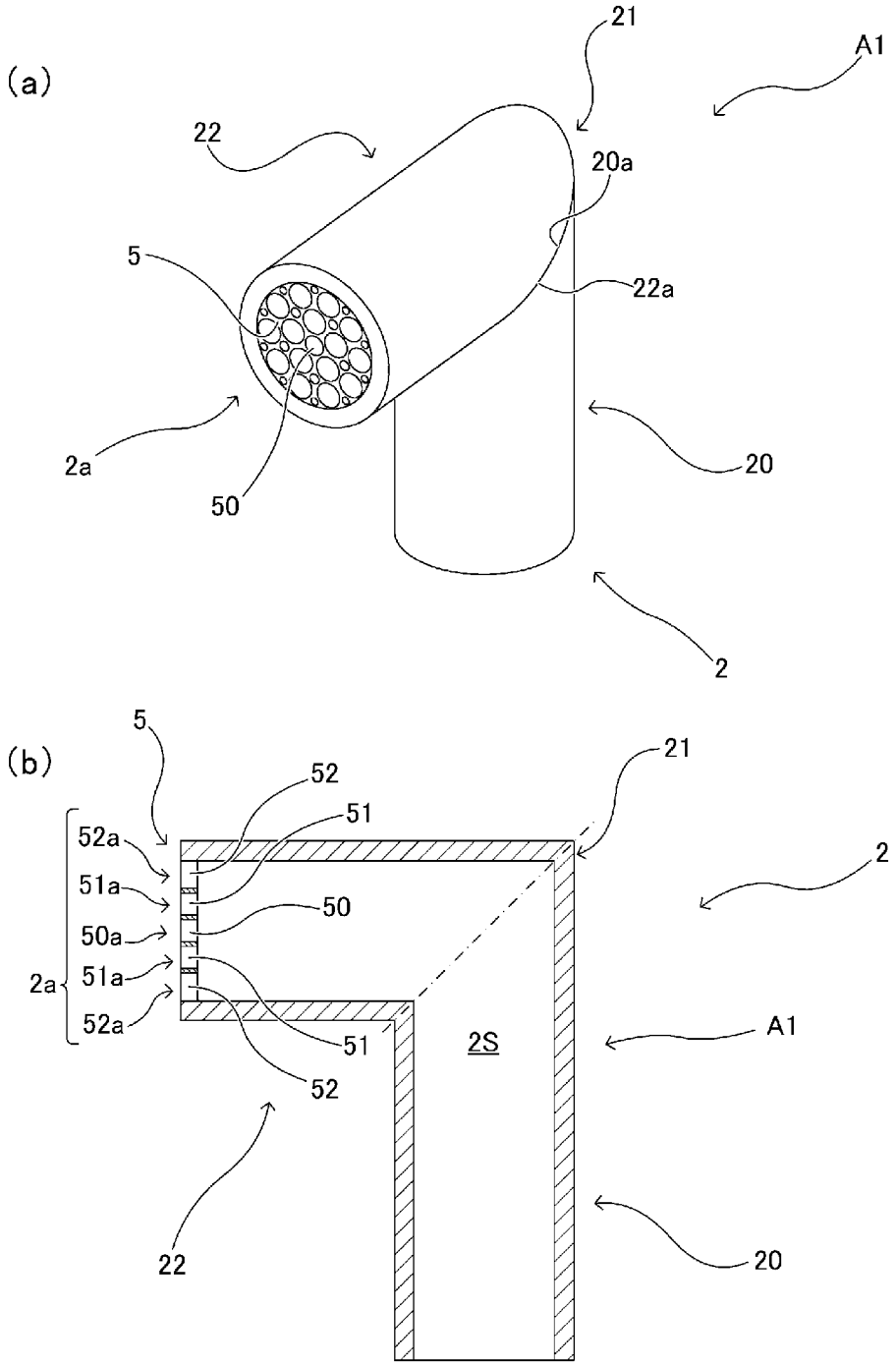
FIG. 6 shows a perspective view and a sectional view indicating the nozzle structure according to the second embodiment.
Figure 7:
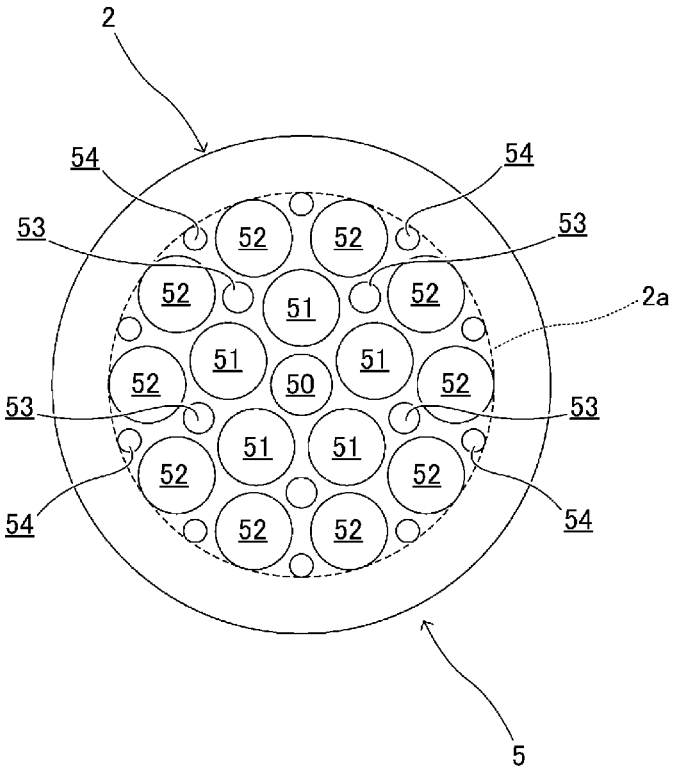
FIG. 7 is a front view showing the composition of the perforated plate according to the second embodiment.
Figure 8:
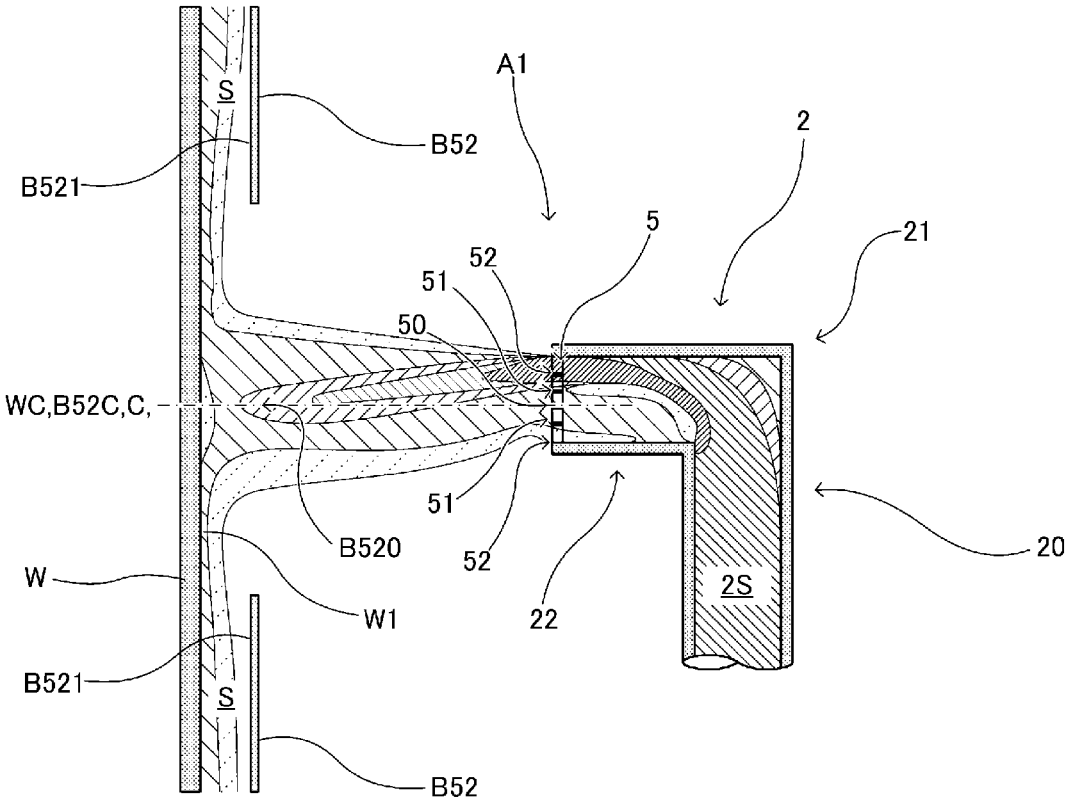
FIG. 8 a schematical velocity distribution map of jet by the nozzle structure according to the second embodiment.

Next, a nozzle structure A1 according to the second embodiment will be described. FIG. 6(*a*) and FIG. 6(*b*) are perspective view and sectional view indicating composition of the nozzle structure according to the second embodiment. FIG. 7 is a front view indicating composition of a perforated plate according to the second embodiment. FIG. 8 is a schematical view of velocity distribution map according to the nozzle structure of the second embodiment. Here, in the description hereinafter, elements and the like having the same composition as those in the first embodiment will be described by using the same signs in the first embodiment and explanation thereof will be omitted.

The nozzle structure A1 according to the present embodiment is constructed from a perforated plate 5 arranged at the opening portion 2*a* of the nozzle 2, the perforated plate 5 arranging a plurality of jet flow hole 50~54 in the opening portion 2*a*.

The perforated plate 5 is a disc-shaped and the jet flow holes 50~54 are formed on the plate surface so as to penetrate the plate. Here, the perforated plate 5 may be contacted and fixed on the opening end surface of the opening portion 2*a* of the jet nozzle 2 and the perforated plate may be contacted and fixed in the opening inner edge of the opening portion 2*a* of the jet nozzle on the outer surface.

In the perforated plate 5, the jet flow holes 50~54 are penetrated so that the opening portion 2*a* is perforated with aperture ratio of approximate 65~75% under a state that the perforated plate 5 is arranged in the opening portion 2*a* of the jet nozzle 2.

The plurality of jet flow holes 50~54 are penetrated the plate in a plate thickness direction and formed while retaining predetermined pitch radially and concentrically (like tree ring) from the plate center of the perforated plate 5 toward the outer side in front view (in axial direction view of the jet nozzle 2).

Concretely, in the plurality of jet flow holes, holes having different hole diameters are arranged. The jet flow holes are composed from total 31 holes of one center medium hole 50 penetrated and formed in the center of the plate surface, five inner large holes 51 penetrated and formed around the perimeter of the center medium hole 50, ten outer large holes 52 penetrated and formed along the outer annulus of the outer side than the inner large hole 51, five middle side medium small holes 53 penetrated and formed in gap part between the inner large hole 51 and the outer large hole 52 and ten outer small holes 10 penetrated and formed the gap part between the outer large hole2 52, 52 adjacent to each other.

The hole diameter size of each of the jet flow holes 50~54 satisfies: inner large hole 51=outer large hole 52>center medium hole 50>middle side medium small hole 53>outer small hole 54. The aperture ratio of the perforated plate 5 is expanded as possible.

Thereby, the aperture ratio of the nozzle opening portion 2*a* is increased as possible, drift is suppressed while decreasing careless pressure loss of the plating liquid in the nozzle, jet flow rectified toward the semiconductor wafer W can be produced with predetermined flow velocity and flow amount from each of the terminal end opening portion 50*a*~54*a* of the jet flow holes 50~54.

Concretely, since the perforated plate 5 in which aperture ratio is squeezed than the nozzle diameter is arranged to the nozzle opening portion 2*a*, drift occurring in the horizontal part 22 after the plating liquid flows out from the vertical part 20 of the jet nozzle 2 and the bent part 21 receives attenuation and rectification function in the perforated plate 5 and the plating liquid is temporarily stored in the horizontal part 22.

At the same time, inner portion of the plating liquid jet nozzle 2 is increased up to constant pressure and the plating liquid received attenuation and rectification function go into each of the jet flow holes 50~54 and is rectified, thereby the plating liquid is finally ejected from each of the terminal end opening portion 50*a*~54*a* as jet flow.

That is, the jet flow holes 50~54 as the jet flow path functions as orifices and drift is rectified, thereby nozzle liquid jet flow with uniform flow velocity and flow amount can be produced.

Here, as the other embodiment, as for the plurality of jet flow holes in the perforated plate 5, penetration direction, hole diameter or hole number may be changed to correspond for drift occurring within the plating liquid jet nozzle 2.

For example, in order to attenuate flow velocity in the maximum velocity area of bent flow outermost circumference side occurring in the horizontal part 22 through the bent part 21, as for the jet flow holes formed on upper portion of the perforated plate, slanted holes which is slanted toward the center side from the outer side may be used, hole diameters mat be gradually decreased from the lower portion to the upper portion of the perforated plate 5 and number of jet flow holes may be decreased.

Further, as the other embodiment, by combining the plurality of partition walls 4, 4' in the first embodiment and the perforated plate 5 in the present embodiment, the plurality of jet flow paths 3~3" and 50~54 may be formed in the opening portion 2*a* of the plating liquid jet nozzle 2.

As mentioned in the above, according to the present invention, in spite of simple structure, the plating liquid is approximately uniformly jetted against the semiconductor surface opposing thereto and decentralization and homogenizing of the plating liquid in the plating tank is conducted, thus thickness growth can be promoted. Further, the nozzle structure can be installed in reduced space with low cost and the plating film having in-plane uniformity can be formed on the semiconductor wafer in a short time.

That is, in the nozzle structure in jet plating tank of a plating apparatus according to the embodiments, a semiconductor wafer is arranged near one side wall of the jet plating tank and a nozzle for jetting plating liquid is arranged so as to oppose the semiconductor wafer, plating is conducted on a semiconductor wafer surface, wherein a plurality of jet paths in an opening portion of the nozzle for jetting the plating liquid and decentralization and homogenization of the plating liquid in the plating tank is conducted by the plating liquid jetted from a terminal end opening portion of each jet path. Thereby, the plating liquid flowing out from upstream to downstream through single path can be diverged by the plurality jet paths formed in the opening portion of the nozzle and split ejection of the plating liquid can be done. Therefore, flow velocity of the plating liquid ejected from each jet path can be rectified to a constant velocity, thus flow of the plating liquid in the plating tank can be in order to a predetermined direction and occurrence of drift can be suppressed.

Further, the plurality of jet paths formed in the opening portion of the jet nozzle for jetting the plating liquid are formed by a plurality of partition walls formed in the opening portion of the nozzle. The plating liquid can be diverted in each jet path, thereby the plating liquid can be substantially uniformly and radially spread from the opening portion of the jet nozzle of the plating liquid, thus the plating liquid can be sent to the semiconductor wafer.

Further, the plurality of jet paths formed in the opening portion of the jet nozzle for jetting the plating liquid are formed by a perforated plate arranged in the opening portion of the nozzle. In spite that the structure is further simplified, similar to the above, that is, the velocity difference occurring in bent flow of the plating liquid due to influence low-pressure area of the inner side and high-pressure area of the outer side in the bent portion of the nozzle can be dissolved, thus rectifying action by which flow velocity is approximately homogenized can be further improved.

Further, the jet plating tank has a donut-like plate arranged between the semiconductor wafer arranged in the one side wall and the nozzle for jetting plating liquid, wherein the donut-like plate has a circular ring opening in a center thereof and a wall surface thereof opposes to the semiconductor wafer while forming a regular interval therebetween, and wherein a center of the ring opening concentrically positions with a center of the nozzle opening portion of the jet nozzle of the plating liquid and a center of semiconductor wafer. Thereby, the wall flow of the plating liquid going to the outer side from the center of the semiconductor wafer flows with a predetermined distance, thus it can be suppressed that the wall flow becomes turbulence due to that the wall flow is attenuated in the outer side. Thus, the plating liquid evenly contacts with entire area of the semiconductor wafer surface, therefore formation of the plating film without uneven spots can be promoted.

As mentioned, according to the present invention, the plating film with uneven spots can be formed in a short time while evenly contacting the plating liquid over all area of the wafer surface and promoting thickness growth.

The invention claimed is:

1. A plating apparatus comprising a jet plating tank and a nozzle for jetting a plating liquid to a semiconductor wafer in the jetting plating tank, wherein the nozzle comprises a cylindrical pipe having an L-shape with a vertical pipe and a horizontal pipe, and an opening portion for jetting the plating liquid is disposed at an end of the horizontal pipe, and wherein L-shaped partition walls are disposed inside the vertical pipe and the horizontal pipe of the cylindrical pipe to form a plurality of jet paths to the opening portion, the L-shaped partition walls have vertical walls and horizontal walls, the vertical walls are parallel to each other, and the horizontal walls are parallel to each other.

2. The plating apparatus according to claim 1, wherein the jet plating tank has a donut-like plate arranged between the semiconductor wafer arranged in the one side wall and the nozzle for jetting plating liquid, wherein the donut-like plate has a circular ring opening in a center thereof and a wall surface thereof opposes to the semiconductor wafer while forming a regular interval therebetween, and wherein a center of the ring opening concentrically positions with a center of the nozzle opening portion of the nozzle of the plating liquid and a center of semiconductor wafer.

3. A plating apparatus comprising a jet plating tank and a nozzle for jetting a plating liquid to a semiconductor wafer in the jetting plating tank, wherein the nozzle comprises a cylindrical pipe having an L-shape with a vertical pipe and a horizontal pipe, and an opening portion for jetting the plating liquid is disposed at an end of the horizontal pipe, wherein a perforated plate having a plurality of jet flow holes is disposed in the opening portion of the nozzle to form a plurality of jet paths for jetting the plating liquid, and wherein the opening portion, the vertical pipe, and the horizontal pipe have an identical inner diameter.

4. The plating apparatus according to claim 3, wherein the jet plating tank has a donut-like plate arranged between the semiconductor wafer arranged in the one side wall and the nozzle for jetting plating liquid, wherein the donut-like plate has a circular ring opening in a center thereof and a wall surface thereof opposes to the semiconductor wafer while forming a regular interval therebetween, and wherein a center of the ring opening concentrically positions with a center of the nozzle opening portion of the nozzle of the plating liquid and a center of semiconductor wafer.

* * * * *